US010745909B2

(12) United States Patent
Stucky et al.

(10) Patent No.: US 10,745,909 B2
(45) Date of Patent: Aug. 18, 2020

(54) SYSTEM, METHOD, AND APPARATUS FOR CORNER SIDING

(71) Applicant: CERTAINTEED CORPORATION, Malvern, PA (US)

(72) Inventors: David J. Stucky, Grass Lake, MI (US); Stephen W. Steffes, McPherson, KS (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 16/731,219

(22) Filed: Dec. 31, 2019

(65) Prior Publication Data

US 2020/0131758 A1 Apr. 30, 2020

Related U.S. Application Data

(62) Division of application No. 15/689,601, filed on Aug. 29, 2017, now Pat. No. 10,544,580, which is a division of application No. 14/967,569, filed on Dec. 14, 2015, now Pat. No. 9,765,513.

(60) Provisional application No. 62/091,997, filed on Dec. 15, 2014.

(51) Int. Cl.

| | |
|---|---|
| ***E04B 1/68*** | (2006.01) |
| ***E04F 19/02*** | (2006.01) |
| ***E04F 13/073*** | (2006.01) |

(52) U.S. Cl.

CPC ..... *E04B 1/6803* (2013.01); *E04F 13/0733* (2013.01); *E04F 19/024* (2013.01)

(58) Field of Classification Search

CPC ..... Y10T 24/307; Y10T 24/44923; Y10T 24/44983; F16B 12/10; F16B 12/32; F16B 5/0614; F16B 5/06; F16B 5/0607; F16B 5/0621

See application file for complete search history.

(56) References Cited

U.S. PATENT DOCUMENTS

| | | | | | |
|---|---|---|---|---|---|
| 778,533 | A | * | 12/1904 | Dunbar | B65D 9/32 217/70 |
| 791,405 | A | * | 5/1905 | Crandal | E04B 2/723 52/285.3 |
| 893,676 | A | * | 7/1908 | Tschantz | E06B 3/982 403/402 |
| 1,315,260 | A | * | 9/1919 | Tischler | A61G 17/00 52/287.1 |

(Continued)

FOREIGN PATENT DOCUMENTS

| | | | |
|---|---|---|---|
| CA | 160070 | A | 1/1915 |
| EP | 1504164 | B1 | 10/2012 |
| WO | 2003095760 | A1 | 11/2003 |

OTHER PUBLICATIONS

CT-017 Clearance Search Results (2013) 2 pages.
Technical Search (2014) 1 page.

*Primary Examiner* — Brian E Glessner
*Assistant Examiner* — Adam G Barlow
(74) *Attorney, Agent, or Firm* — Abel Schillinger, LLP; Thomas H. Osborn

(57) ABSTRACT

A corner siding product may include a plurality of panels. Each panel may include a front face with a simulated pattern and an inner wall formed along a perimeter of the panel. The corner siding product may further include a clip that is configured engage each panel to hold the panels together and form a corner.

20 Claims, 12 Drawing Sheets

(56) References Cited

U.S. PATENT DOCUMENTS 1,366,175 A 1/1921 Hansen
1,404,483 A 1/1922 Scharwath et al.
2,168,218 A 8/1939 Kirschbraun
2,182,523 A * 12/1939 Markowski ..... E04F 13/0842 52/509
2,252,539 A * 8/1941 Adams ..... E04F 19/024 156/212
2,451,811 A * 10/1948 Daily ..... E04F 13/04 411/461
2,674,914 A * 4/1954 Daily ..... E04B 1/6116 411/460
2,735,143 A 2/1956 Kearns
2,863,352 A * 12/1958 Mikesic ..... E04B 1/38 411/463
2,969,616 A * 1/1961 Gustafson ..... E04F 19/06 52/255
3,200,547 A * 8/1965 Johnson ..... E04F 19/022 52/287.1
3,235,118 A * 2/1966 Kewley ..... F16B 5/0614 217/65
3,321,223 A * 5/1967 Snow ..... F16B 12/32 403/220
3,345,715 A * 10/1967 Lambert ..... A47G 1/105 403/402
3,379,465 A * 4/1968 Raymond ..... B60R 13/043 24/289
3,444,657 A * 5/1969 Swanson ..... E04F 19/022 52/287.1
3,460,282 A * 8/1969 Swirsky ..... B42D 5/04 40/530
3,579,940 A 5/1971 Greenleaf
3,688,459 A * 9/1972 Mattix ..... A47K 3/04 52/35
3,720,031 A * 3/1973 Wilson ..... E04D 1/365 52/520
3,836,217 A * 9/1974 Shiina ..... A47B 47/0041 312/107
3,848,383 A 11/1974 Wilson et al.
3,852,934 A 12/1974 Kirkhuff
3,943,677 A 3/1976 Carothers
3,989,397 A * 11/1976 Baker ..... F16B 12/02 403/205
4,048,101 A 9/1977 Nakamachi et al.
4,128,369 A 12/1978 Kemerer et al.
4,453,471 A * 6/1984 Harrington ..... B65D 9/24 108/55.1
4,470,234 A 9/1984 Rosner
4,472,076 A * 9/1984 Toft, Jr. ..... A47B 57/58 211/186
4,835,925 A 6/1989 Hoffmann, Sr.
4,840,440 A * 6/1989 Dieter ..... F16B 12/46 217/65
4,876,837 A * 10/1989 Kelly ..... B21B 1/082 52/287.1
4,903,445 A * 2/1990 Mankowski ..... E04D 13/174 454/365
4,932,173 A * 6/1990 Commins ..... E04B 1/2608 403/232.1
4,972,647 A * 11/1990 Meldrum ..... E04F 13/0864 52/478
5,138,810 A * 8/1992 Kartler ..... E04F 13/06 52/254
5,217,317 A * 6/1993 Young ..... E04B 1/2612 403/14
5,295,340 A * 3/1994 Collins ..... E04D 1/30 52/276
5,517,794 A 5/1996 Wagner
5,575,131 A * 11/1996 Menchetti ..... E04B 2/7453 52/272
5,598,680 A * 2/1997 Wilhelmi ..... E04B 1/2608 52/715
5,615,523 A * 4/1997 Wells ..... E04D 1/20 52/309.1
5,651,220 A * 7/1997 dit Felix ..... E04B 1/3211 52/285.3
5,711,126 A 1/1998 Wells
5,743,059 A 4/1998 Fifield
5,902,683 A 5/1999 Sieloff
5,946,877 A 9/1999 Gallinat et al.
5,956,914 A 9/1999 Williamson
5,974,748 A 11/1999 Sciuga et al.
5,983,468 A * 11/1999 Evans, III ..... H01L 21/67333 24/457
5,992,116 A 11/1999 Ternes et al.
6,021,611 A 2/2000 Wells et al.
6,112,492 A 9/2000 Wells et al.
6,125,602 A 10/2000 Freiborg et al.
6,253,507 B1 * 7/2001 Martino ..... E06B 1/06 403/404
6,418,692 B1 * 7/2002 Freshwater ..... E04D 1/30 52/199
6,438,914 B1 * 8/2002 Robertson ..... E04F 13/06 52/255
6,530,189 B2 3/2003 Freshwater et al.
6,592,025 B2 * 7/2003 Bazany ..... B65D 5/0055 220/4.28
6,883,282 B1 4/2005 Newhart, III
7,228,665 B2 * 6/2007 Perry ..... E04D 1/30 52/287.1
D568,496 S * 5/2008 Trabue ..... D25/102
7,389,564 B2 * 6/2008 Lautenschlager ..... E05D 5/0238 16/382
7,389,618 B1 * 6/2008 Herkstroeter ..... E04B 1/34321 52/285.3
7,587,864 B2 * 9/2009 McCaskill ..... E04D 1/205 136/243
7,677,830 B1 * 3/2010 Brown ..... A47C 3/00 403/381
7,793,475 B2 * 9/2010 Riggs ..... E04F 13/06 52/255
7,922,417 B2 * 4/2011 Jimenez ..... A47B 47/0083 108/193
7,958,691 B1 * 6/2011 Newhouse ..... E04F 19/022 312/111
7,967,401 B2 * 6/2011 Hsu ..... A47B 47/0008 312/108
8,136,322 B2 3/2012 Shadwell et al.
8,209,938 B2 7/2012 Gaudreau et al.
8,261,505 B2 9/2012 Kalkanoglu et al.
8,371,081 B2 2/2013 Bennett et al.
8,375,663 B2 2/2013 Johnston et al.
8,453,408 B2 * 6/2013 Kalkanoglu ..... E04D 1/30 52/43
8,453,410 B2 6/2013 Kalkanoglu et al.
8,516,765 B2 8/2013 Shaw et al.
8,572,921 B2 * 11/2013 Ward ..... B29C 43/003 52/518
8,590,270 B2 11/2013 Martinique
8,677,709 B2 3/2014 Dilonardo et al.
8,756,886 B1 * 6/2014 Grant ..... E04F 13/0733 52/254
8,783,798 B2 * 7/2014 Zhang ..... A47B 96/00 312/111
8,813,985 B2 * 8/2014 Schloesser ..... B65D 7/24 206/600
8,850,771 B2 10/2014 Jenkins et al.
10,113,317 B1 * 10/2018 Laydera-Collins ..... E04F 13/0858
2001/0037617 A1 * 11/2001 Chi ..... E04F 19/028 52/288.1
2002/0121057 A1 9/2002 Steffes et al.
2004/0068946 A1 * 4/2004 Byun ..... A47B 47/0033 52/285.3
2004/0074175 A1 4/2004 Tierney
2005/0072092 A1 4/2005 Williams
2005/0089672 A1 4/2005 Kuipers et al.
2005/0153103 A1 7/2005 Meyer et al.

(56) References Cited

U.S. PATENT DOCUMENTS

2005/0262784 A1* 12/2005 Justice ..... E04F 13/0864 52/287.1
2006/0026908 A1* 2/2006 Gregori ..... E04D 1/20 52/105
2006/0130419 A1 6/2006 Bowman
2008/0148660 A1* 6/2008 Wambaugh ..... E04F 13/06 52/285.3
2008/0216426 A1* 9/2008 Bunker ..... E04B 1/34315 52/285.3
2008/0236064 A1 10/2008 Sippola
2009/0084058 A1 4/2009 Cahill et al.
2009/0205279 A1* 8/2009 Koenig, Jr. ..... E04F 13/06 52/417
2009/0223027 A1* 9/2009 Reznar ..... E04F 15/04 24/457
2010/0058696 A1* 3/2010 Mills ..... E01C 11/106 52/396.05
2011/0023392 A1 2/2011 Rosenthal et al.
2011/0061323 A1 3/2011 Schwarz et al.
2011/0192519 A1* 8/2011 Gangl ..... E04F 13/14 156/40
2012/0085053 A1 4/2012 Barone
2012/0117906 A1 5/2012 Moller, Jr. et al.
2012/0117908 A1 5/2012 Turek et al.
2012/0167498 A1* 7/2012 Wright ..... E04F 17/04 52/220.1
2012/0324812 A1 12/2012 Robertson
2013/0026165 A1* 1/2013 Kvols ..... B65D 19/12 220/4.33
2013/0315652 A1* 11/2013 Eding ..... B65D 9/24 403/20
2014/0000213 A1* 1/2014 Klein ..... E04B 1/40 52/712
2015/0167313 A1 6/2015 Steffes et al.
2016/0215801 A1* 7/2016 Munch-Fals ..... F16B 5/0614
2017/0055700 A1* 3/2017 Chung ..... A47B 47/0033

* cited by examiner

SYSTEM, METHOD, AND APPARATUS FOR CORNER SIDING

CROSS REFERENCE TO RELATED APPLICATIONS

This application is a divisional of and claims priority to U.S. patent application Ser. No. 15/689,601, filed Aug. 29, 2017, by David J. STUCKY et al. and entitled "SYSTEM, METHOD AND APPARATUS FOR CORNER SIDING," which is a divisional of and claims priority to U.S. application Ser. No. 14/967,569, filed Dec. 14, 2015, by David J. STUCKY et al. and entitled "SYSTEM, METHOD AND APPARATUS FOR CORNER SIDING," now U.S. Pat. No. 9,765,513, issued Sep. 19, 2017, which claims priority to and the benefit of U.S. Provisional Patent Application No. 62/091,997, filed Dec. 15, 2014, by David J. STUCKY et al. and entitled "SYSTEM, METHOD AND APPARATUS FOR CORNER SIDING," which are assigned to the current assignee hereof and incorporated herein by reference in their entireties.

BACKGROUND OF THE INVENTION

The present invention relates in general to building products and, in particular, to a system, method and apparatus for corner siding building products.

DESCRIPTION OF THE RELATED ART

Wooden shingles and shakes are popular and attractive siding products used in the construction of homes, businesses, and other structures. Unfortunately, these wooden products require constant maintenance, and are extremely expensive, as well as labor intensive to install. Further, the durability of wooden products, such as those constructed from cedar, lags far behind that of products made of synthetic materials. Therefore, a considerable number of synthetic siding products have been created that simulate the wooden appearance of, for example, cedar shingles or cedar shake shingles. These siding products are typically formed from materials such as polyvinyl chloride and polypropylene.

Once siding panels are installed onto the exterior sheathing of a structure, it often becomes necessary to place a corner cap over the exposed ends of the siding panels. Efforts have been made to match the ornamental appearance of the siding panel with the corner cap appearance, so as to avoid an unaesthetic or artificial looking final structure.

Prior art corner pieces typically suffer from several drawbacks. First, the appearance of a random selection of shingles within each course formed on the siding panels does not continue through to the corner pieces when they have identical faces. The courses do not appear as if they terminate in a natural manner at the corners of the structure. This unnatural appearance occurs when employing either the multiple course corner piece, where the faces are identical, or when employing the single course corner piece, where the faces are identical.

Further, when viewing only a single wall of a structure that includes a prior art corner piece, it becomes quite apparent that artificial corner pieces have been employed. A continuous and non-staggered lateral edge is apparent along the entire corner of the structure between corner pieces in a vertical stack, one on top of the other. The linear joint formed between the siding corner pieces and the siding panels is apparent to even a casual observer.

Therefore, there remains a need for a corner piece that provides the appearance of a more natural termination of the courses of a siding facade employing simulated cedar impression siding panels and for a corner piece that more effectively blends the corner piece into the facade to mask the presence of the corner piece and promote the overall desired appearance of a random selection of individual shingles.

SUMMARY

Embodiments of a corner siding product may include a plurality of panels. Each panel may include a front face with a simulated pattern, a hollow back, a longitudinal length L extending in an x-direction, a lateral width W extending in a y-direction, and a depth D extending in a z-direction. In addition, the corner siding product may include a living hinge extending in the y-direction between the panels along side edges thereof.

Embodiments of the corner siding product can have an uninstalled configuration wherein it is substantially planar. Embodiments of the corner siding product also can have an installed configuration wherein the living hinge permits the panels to be non-planar relative to each other, such that they are complementary in shape to a corner of a building.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope, as there may be other equally effective embodiments as understood by those of ordinary skill in the art.

The use of the same reference symbols in different drawings indicates similar or identical items.

DETAILED DESCRIPTION

Figure 1:
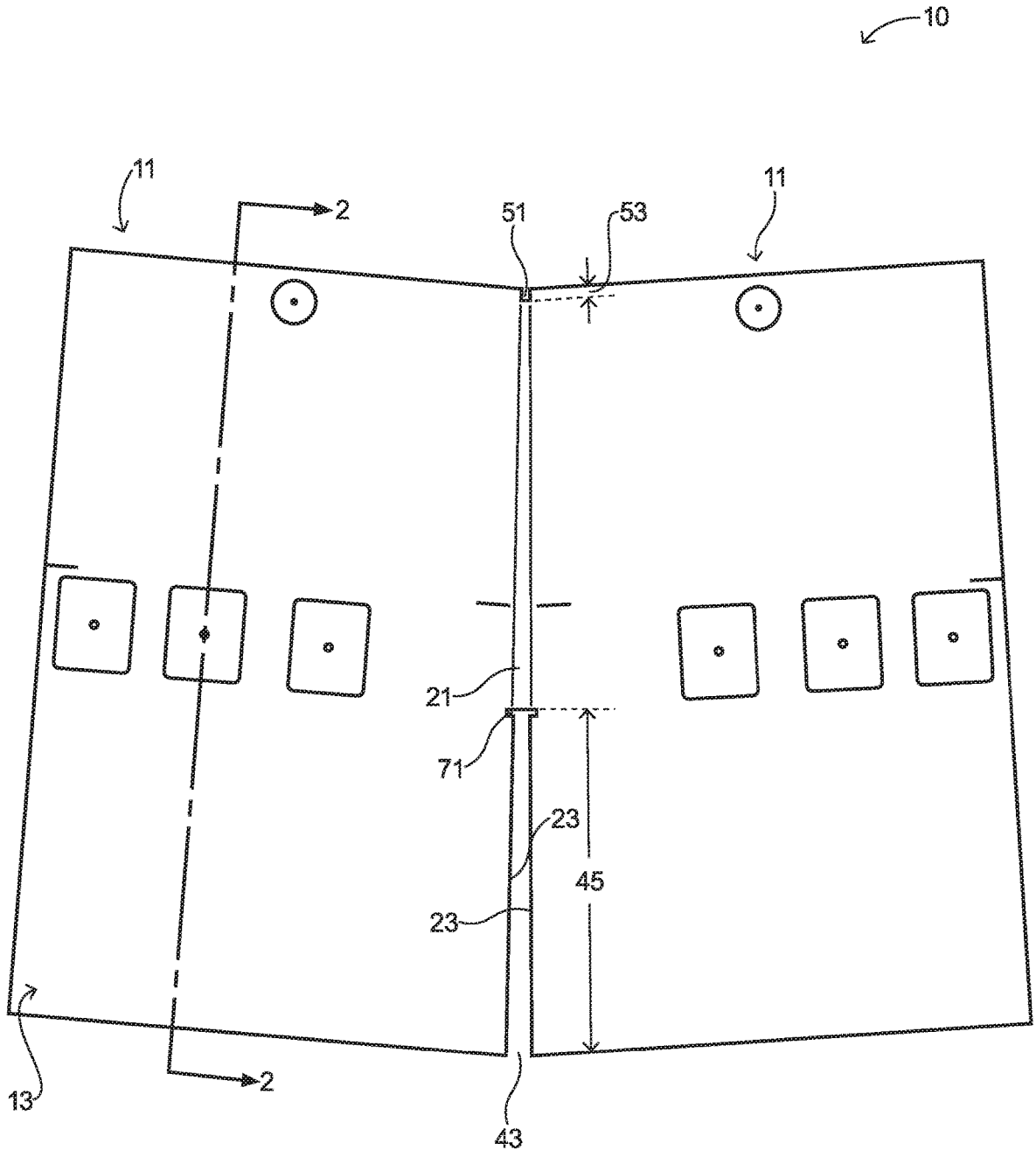
FIG. 1 is a front view of an embodiment of corner siding in an uninstalled configuration.
Figure 2:
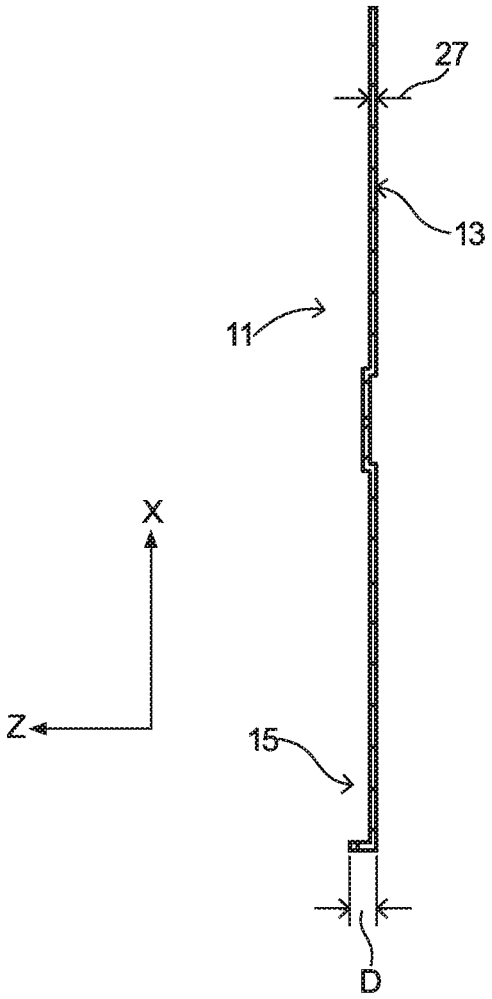
FIG. 2 is a sectional end view of the corner siding of FIG. 1, taken along the line 2-2.
Figure 3:
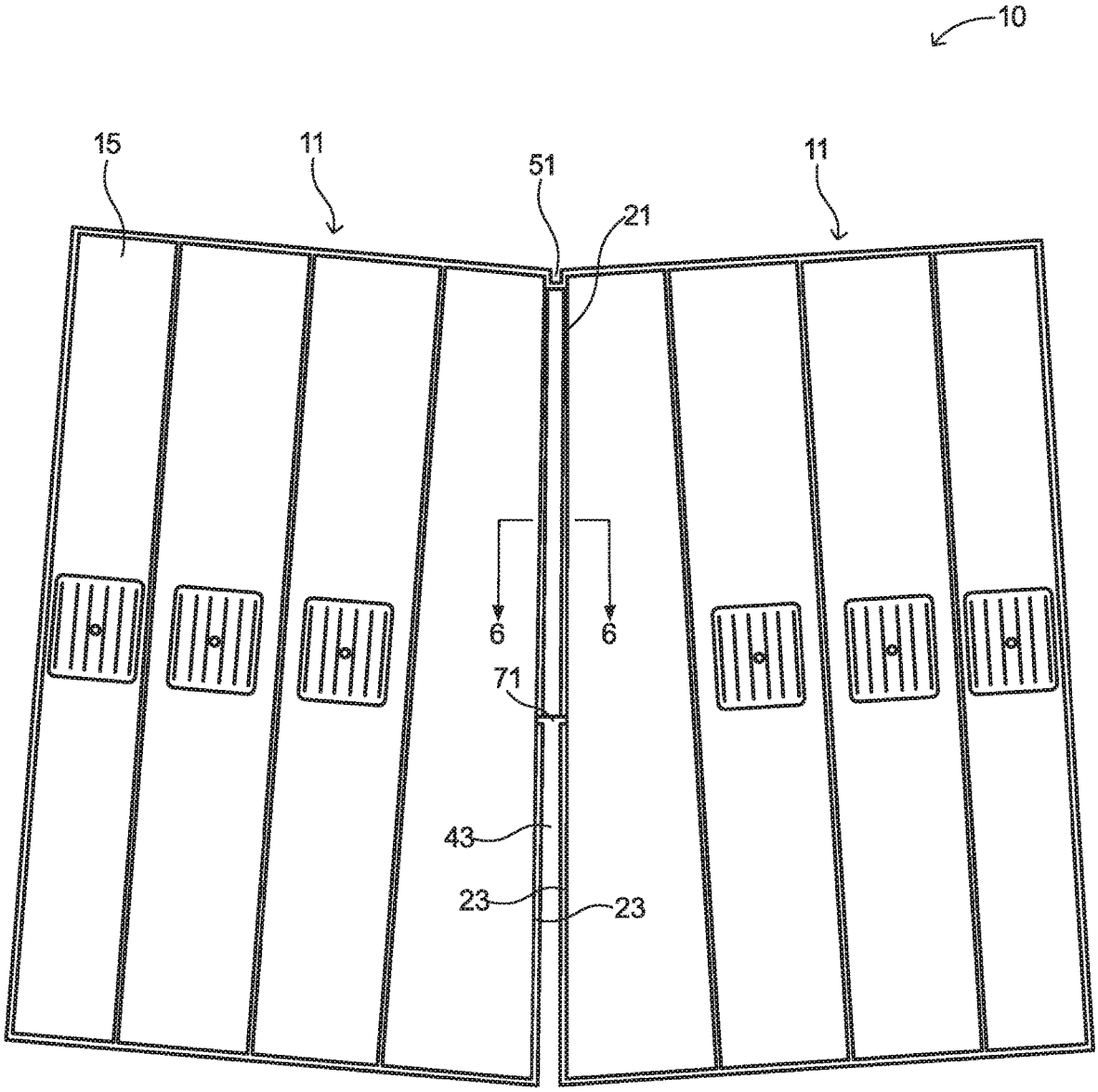
FIG. 3 a rear view of an embodiment of corner siding, in the uninstalled configuration.

Embodiments of a system, method and apparatus for corner siding are disclosed. For example, as shown in FIGS. 1-8, a corner siding product 10 may include one or more panels 11 (e.g., only two shown). Each panel 11 may comprise a front face 13 (FIG. 2) with a simulated pattern, such as a simulated wood grain, like cedar. Each of the panels 11 may include a selected shape, such as a rectangular shape, a trapezoidal shape, or a right trapezoidal shape, for example.

In some versions, panel 11 may include a hollow back 15 (FIG. 3), a longitudinal length L (FIG. 4) extending in an x-direction, a lateral width W extending in a y-direction, a depth D (FIG. 2) extending in a z-direction. Embodiments of panel 11 may comprise a hinge, such as a living hinge 21 that extends in the y-direction between the panels along inner side edges 23 thereof. The living hinge 21 can be a double-hinge, as shown, or a single hinge. In various embodiments, the living hinge 21 may comprise one or more hinges along the x-axis between panels 11.

In some embodiments, the corner siding product 10 may have an uninstalled configuration (FIG. 1) that can be substantially planar. In addition, the corner siding product 10 can have an installed configuration (FIG. 5), where the living hinge 21 permits the panels 11 to be non-planar relative to each other, such that they are complementary in shape to a corner of a building.

Versions of the living hinge 21 can have a thickness 25 (FIG. 6) that is less than a thickness 27 (FIG. 2) of one of the panels 11, relative to the z-direction. Embodiments of the living hinge thickness 25 can be at least about 0.010 inches, such as at least about 0.020 inches, or even at least about 0.030 inches. In other versions, the living hinge thickness 25 can be not greater than about 0.040 inches, such as not greater than about 0.030 inches, or even not greater than about 0.020 inches. Embodiments of the living hinge thickness 25 can be in a range between any of these values.

Embodiments of the panel thickness 27 can be at least about 0.070 inches, such as at least about 0.080 inches, or even at least about 0.090 inches. In other versions, the panel thickness 27 can be not greater than about 1.010 inches, such as not greater than about 1.000 inches, or even not greater than about 0.090 inches. Embodiments of the panel thickness 27 can be in a range between any of these values.

Figure 5:
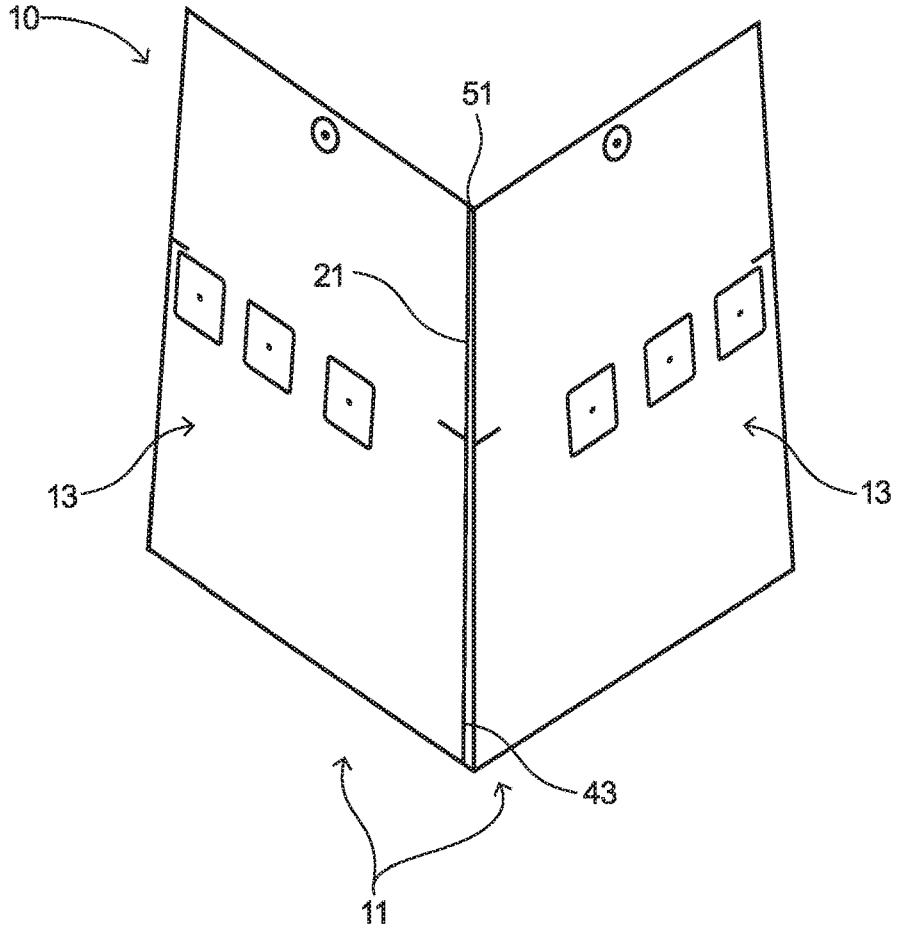
FIG. 5 is a front isometric view of an embodiment of corner siding in the installed configuration.
Figure 6:
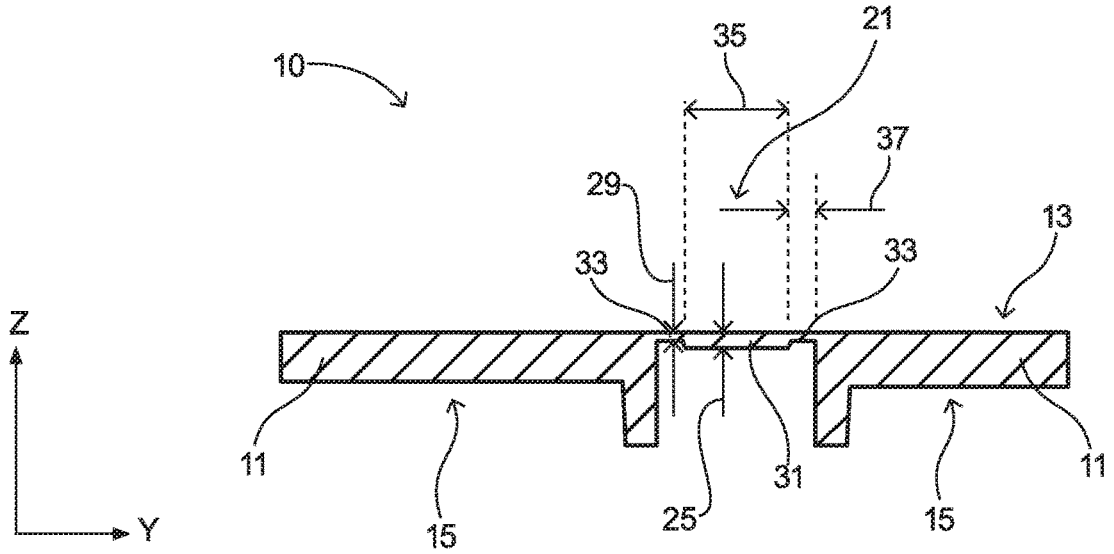
FIG. 6 is a top sectional view of the corner siding of FIG. 3, taken along the line 6-6.

Versions of the living hinge 21 may include a hinge body 31 (FIG. 6) and hinge sides 33 on opposite sides of the hinge body 31. The hinge body 31 can have the hinge body thickness 25, which can be greater than a thickness 29 of one of the hinge sides 33, relative to the z-direction. In some versions, the hinge body 31 (FIG. 6) can have a hinge body width 35 that is greater than a width 37 of one of the hinge sides 33, relative to the y-direction. The corner siding product 10 can hinge along at least one of the hinge sides 33 when in the installed configuration (FIG. 5).

In some examples, the hinge sides' thickness 29 can be at least about 0.010 inches, such as at least about 0.020 inches. Other versions of the hinge sides' thickness can be not greater than about 0.030 inches, such as not greater than about 0.020 inches. Embodiments of the hinge sides' thickness 27 can be in a range between any of these values.

Figure 4:
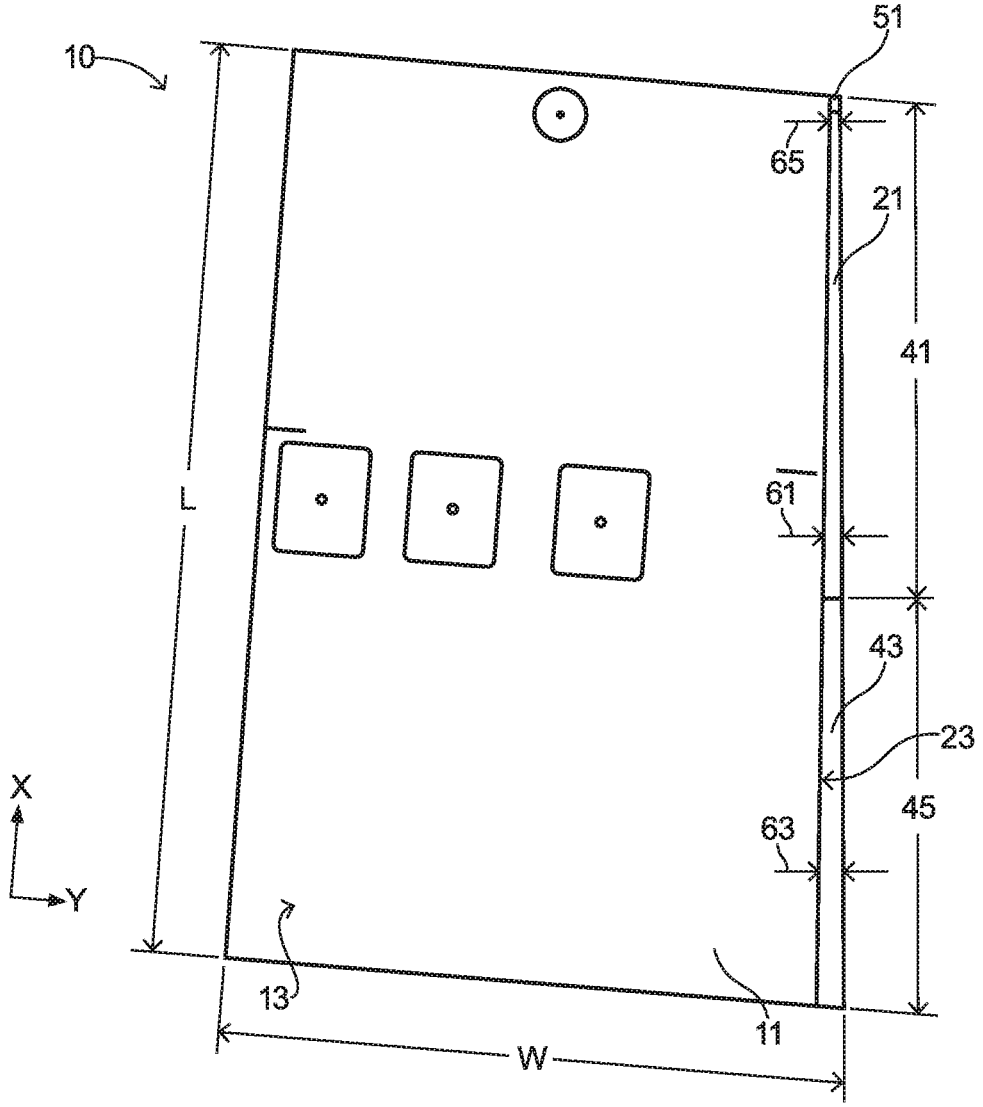
FIG. 4 is a side view of an embodiment of corner siding in an installed configuration.

Embodiments of the living hinge 21 can have a length 41 (FIG. 4). Length 41 can be equal to or less than a length L of the panels 11, relative to the x-direction. In some versions, a first slot 43 is located between the panels 11 adjacent the living hinge 21. The first slot 43 can have a length 45 that is less than the living hinge length 41, relative to the x-direction. In addition, a second slot 51 (FIGS. 1, 4, 5) can be included between the panels 11 opposite the first slot 43. For example, the living hinge 21 can be located between the first and second slots 43, 51. In some embodiments, the first slot length 45 can be greater than a length 53 of the second slot 51, relative to the x-direction. In some versions, each of the living hinge 21, first slot 43 and second slot 51 can have a width 61, 63, 65, respectively, extending in the y-direction that increases along a length L of the panels in the x-direction. In a particular example, the corner siding product 10 may consist of only one living hinge 21, the slots 43, 51 may be formed in the corner siding product 10 on each longitudinal end of the living hinge 21, and each slot 43, 51 may be tapered.

Embodiments of the corner siding product 10 may further include a transverse slot 71 (FIG. 1) adjacent the living hinge 21. For example, the transverse slot 71 can intersect at least one of the first and second slots 43, 51 (e.g., shown intersecting slot 43 in FIG. 1). The transverse slot 71 can be substantially perpendicular to said at least one of first and second slots 43, 51. In some versions, the corner siding product 10 can include a pair of transverse slots 71 that respectively intersect the first and second slots 43, 51 adjacent the living hinge 21. In some embodiments, the transverse slot 71 that intersects the first slot 43 can be wider in the y-direction than the transverse slot that intersects the second slot 51.

Alternate embodiments of the corner siding product 10 may include a compound mitre, such that each panel 11 is tapered in at least two directions. Versions of the installed configuration (e.g., FIGS. 4 and 5) can include an outside corner defined as two panels 11 forming a convex configuration for the front faces 13 thereof. Alternatively, the installed configuration may include an inside corner (not shown, but with panels 11 inverted) defined as two panels 11 forming a concave configuration for the front faces 13 thereof. Examples of the installed configuration may include an angle formed between the front faces 13 of the panels 11. In particular versions, the angle can be at least about 45 degrees, and can be not greater than about 270 degrees. The angle also can be any angle therebetween. In the installed configuration, the panels 11 can be not orthogonal to each other. In other versions of the installed configuration, the panels 11 can be substantially perpendicular.

Figure 7:
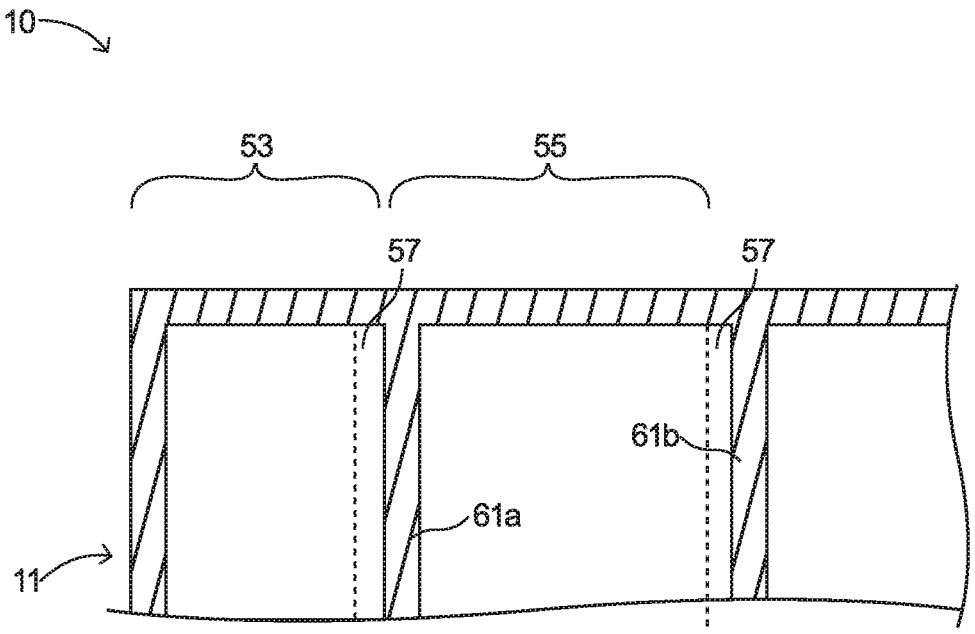
FIGS. 7 and 8 are rear views of embodiments of panels, before and after segmentation, respectively.
Figure 8:
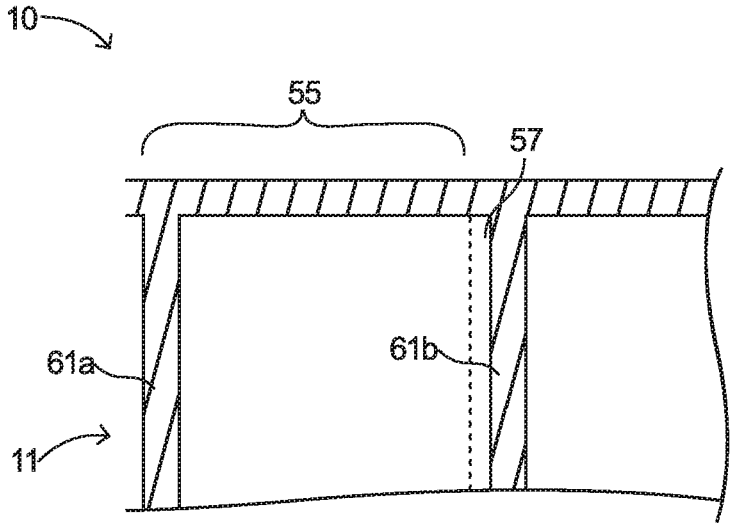

In some versions (FIGS. 7 and 8), each panel 11 of the corner siding product 10 can be cut or trimmed in segments 53, 55. For example, each segment 53, 55 can include a notch 57 (FIG. 7). The notches 57 extend along the longitudinal length of each segment 53, 55 at an outboard intersection of long ribs 61 when facing a rear (i.e., the hollow back 15) of the segment 53, 55. Each segment 53, 55 may include a long rib 61 that extends longitudinally in the hollow back 15. For example, after trimming segment 53 (e.g., along the vertical dashed line in FIG. 7), the long rib 61*a* becomes the outer perimeter side wall (FIG. 8) of the panel 11. The same procedure may be performed for segment 55, such that long rib 61*b* would become the outer perimeter side wall.

Accordingly, at least one panel 11 can be trimmable by at least one segment 53. When the at least one segment 53 is trimmed from the at least one panel 11, the corner panel 10 can include a desired lateral offset effect between vertically adjacent ones of the corner panels 10 in the installed configurations. Examples of the at least one segment 53 may include the notch 57 extending along an outboard side of the hollow back 15 of the at least one panel 11.

Embodiments of the at least one segment 53 may include the long rib 61 that extends longitudinally in the hollow back 15 of the at least one panel 11. After trimming the at least one segment 53, the long rib 61 is an outer perimeter side wall of the at least one panel 11. In some versions, all of the panels 11 include at least one segment 53. In other versions, all of the panels 11 include a plurality of segments 53, 55.

In still other embodiments, the corner siding product 10 may further include at least one clip or fastener. For example, FIGS. 9-14 show examples of clips that can be used to join individual panels that do not have a hinge extending between them. However, the clips may be used with or without panels with hinges. The clips may be used to secure and bind the panels together and form a corner. The panels can otherwise be identical to the various embodiments of the panels described herein.

Figure 9:
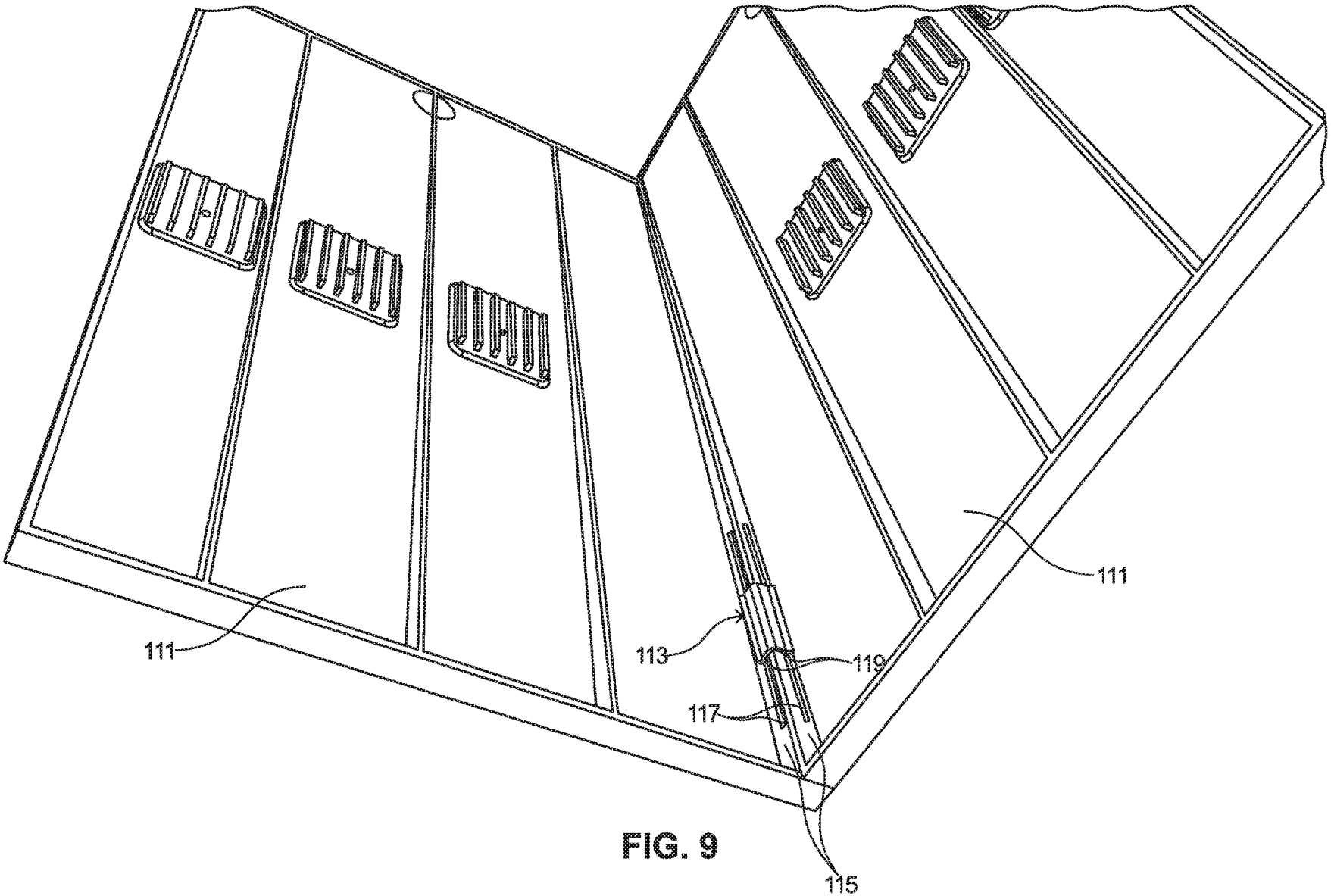
FIG. 9 is a rear isometric view of an embodiment of panels joined with a clip.
Figure 10:
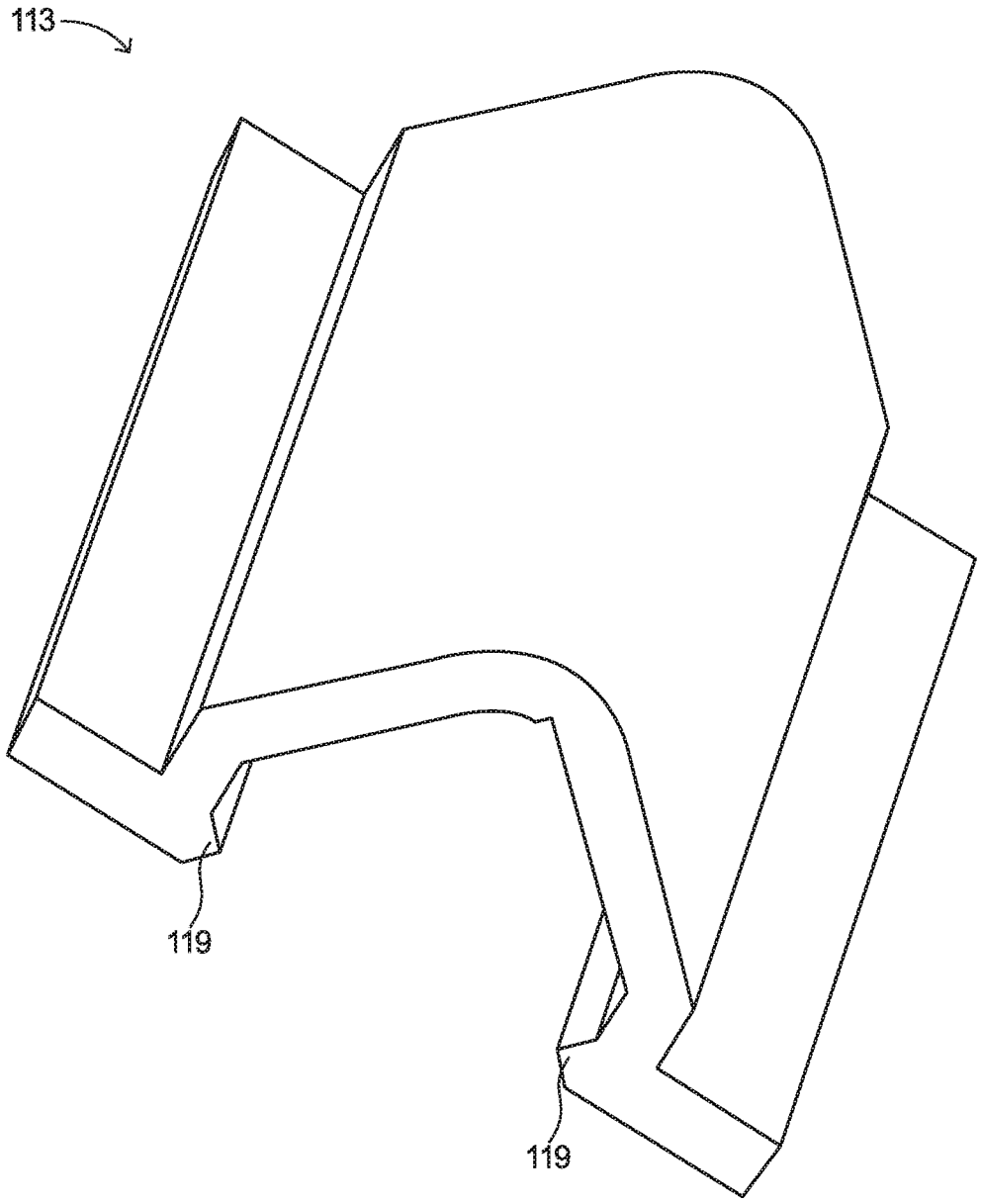
FIG. 10 is an enlarged isometric view of the clip of FIG. 9.
Figure 11:
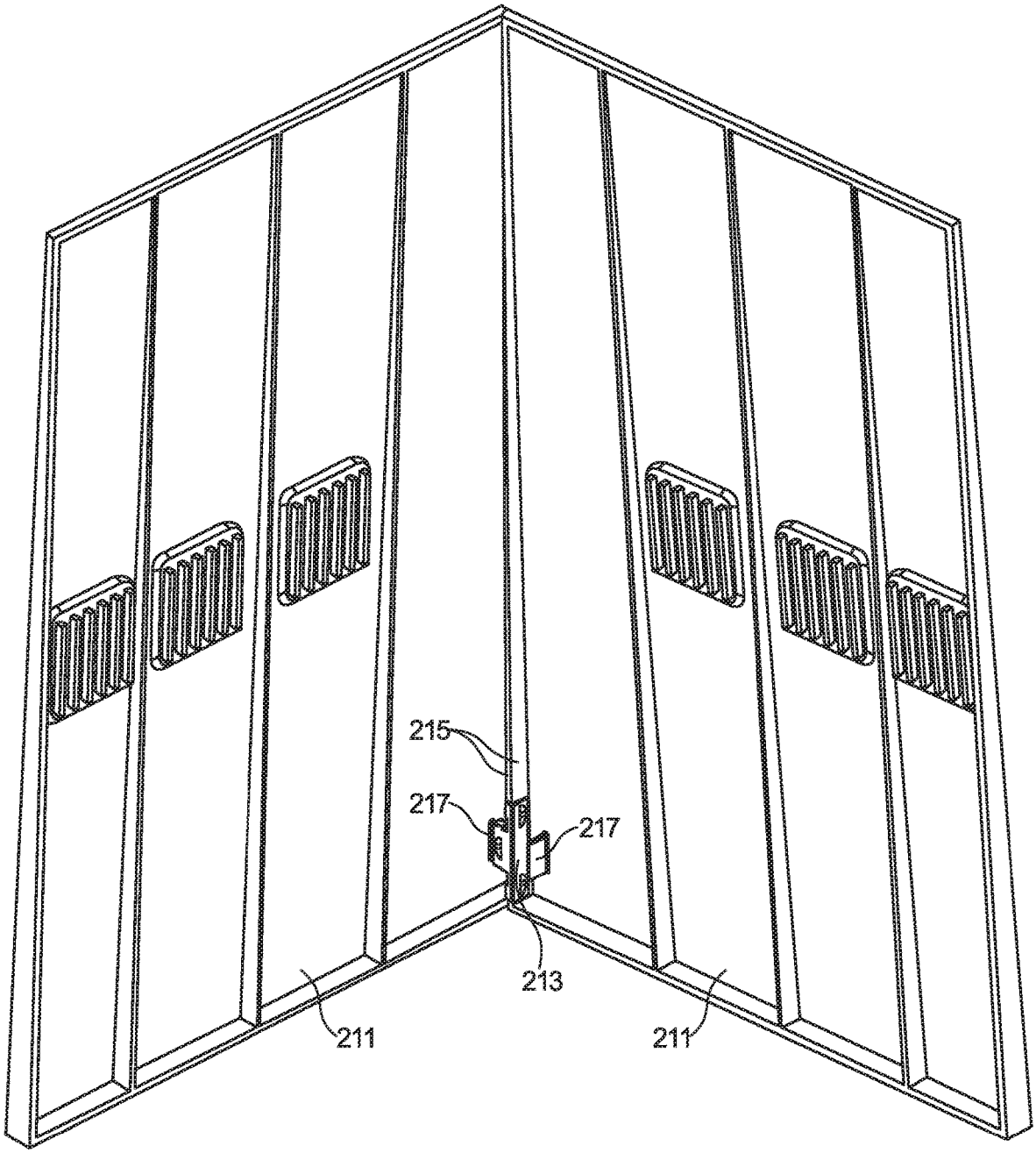
FIG. 11 is a rear isometric view of another embodiment of panels joined with a different clip.

In one embodiment, FIGS. 9 and 10 depict two individual panels 111 and a clip 113. Each panel 111 has an inner wall 115 along their perimeters. The inner walls 115 may be provided with an extended slot or recess 117. The recess 117 may have a consistent sectional shape, such as a narrow rectangular notch. The clip 113 may be formed from a metallic material and, as shown in FIG. 10, may have ribs 119 that protrude inward toward each other to engage the recesses 117 in the installed configuration.

To join two of the panels 111, one panel 111 is perpendicularly placed next to the other panel 111 to form a corner (FIG. 9). One rib 119 of the clip 113 is snapped into one recess 117, and the clip 113 may be snapped into the recess 117 on the other panel 111 to hold the panels 111 together. This design and the clip 113 are reversible, such that either panel 111 can overlap the other.

Figure 12:
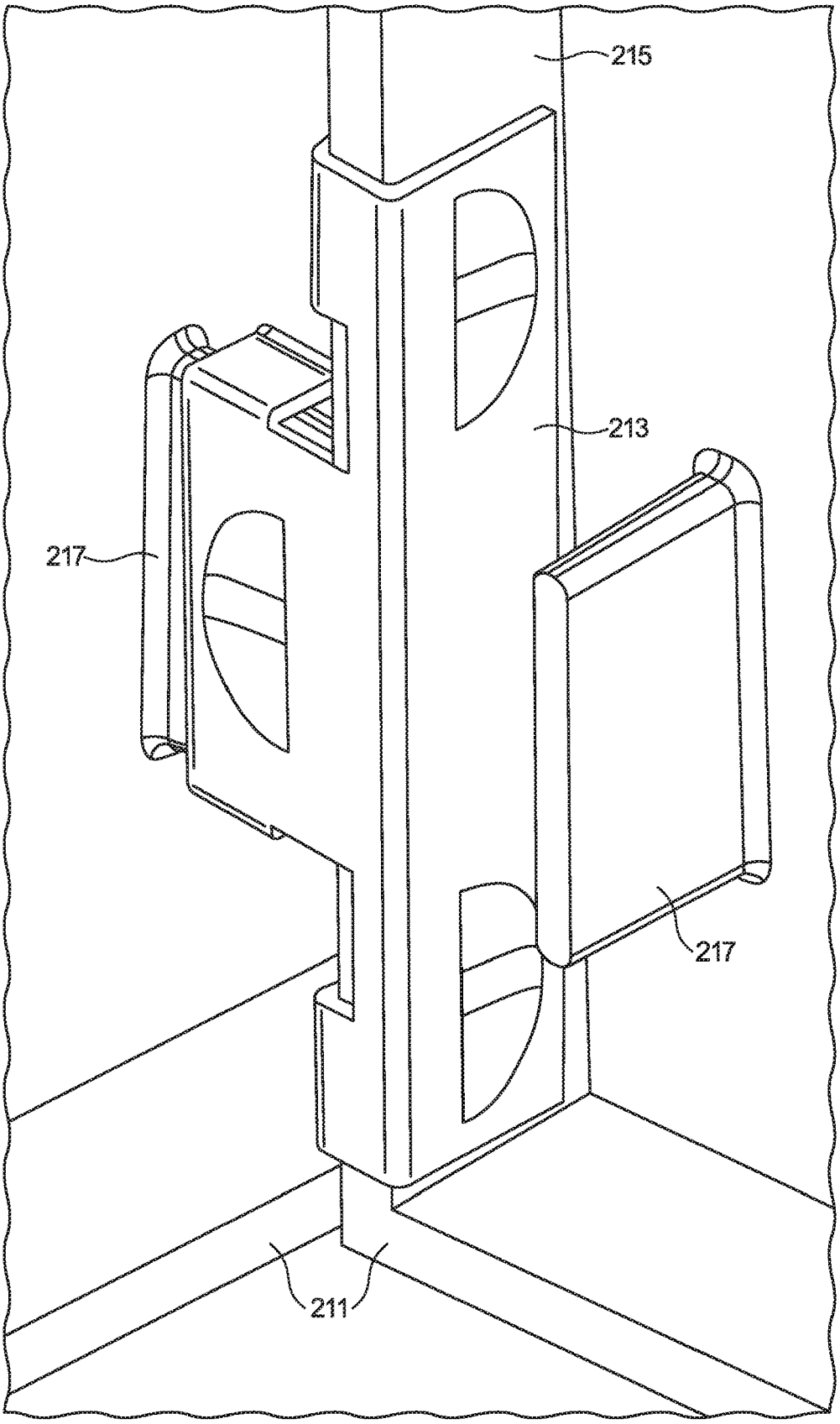
FIGS. 12 and 13 are rear isometric views of the panels and clip of FIG. 11, respectively showing the reversibility of the design.
Figure 13:
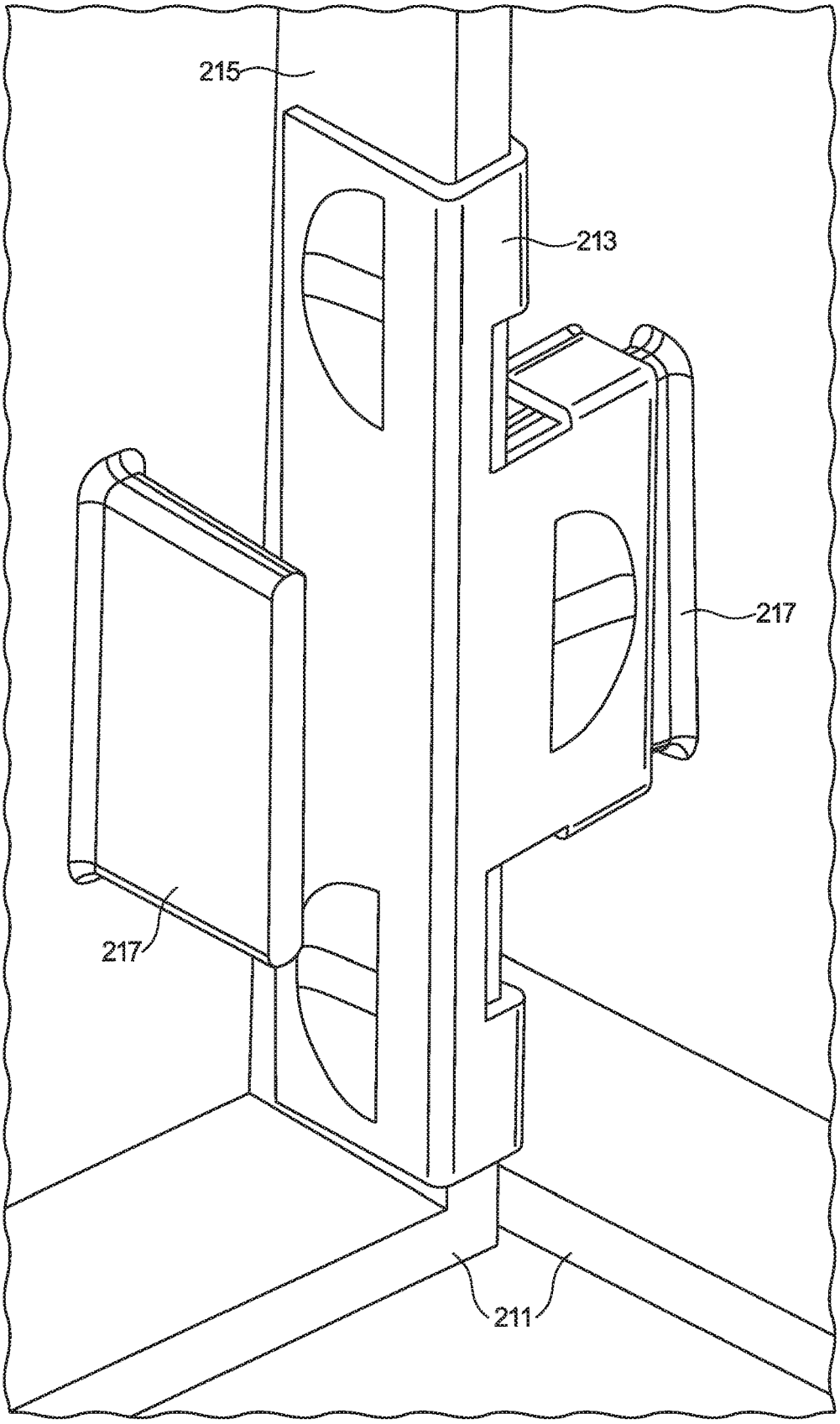
Figure 14:
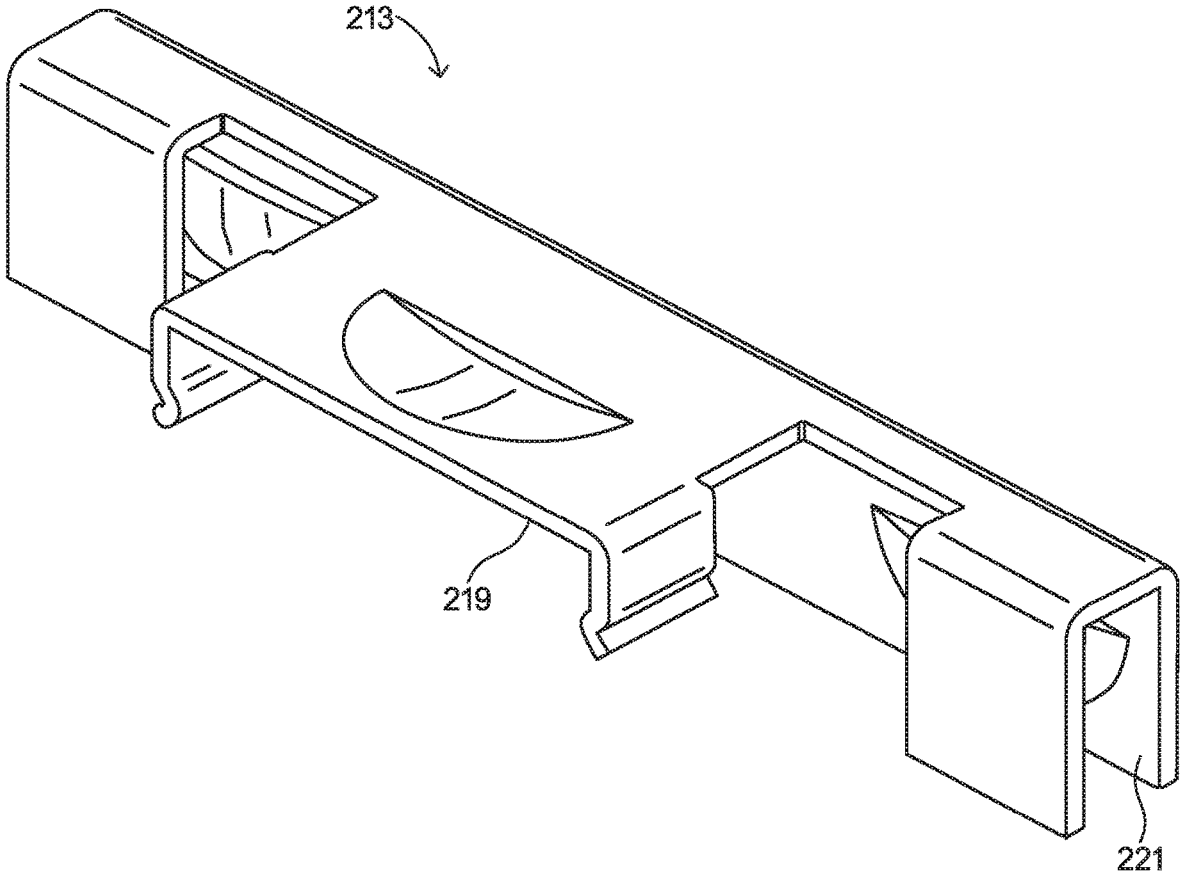
FIG. 14 is an enlarged isometric view of the clip of FIGS. 11-13.

In another embodiment, FIGS. 11-14 depict two individual panels 211 and a clip 213. Each panel 211 has an inner wall 215 along their perimeters. A small rib 217 may extend rearward from the rear surface of each panel 211, adjacent the inner wall 215 and lower inner corner, as shown. The ribs 217 may have a sectional shape, such as a narrow rectangular tab. The clip 213 may be formed from a metallic material and, as shown in FIG. 14, may have one slot 219 sized and shaped to engage and retain one rib 217, and at least one other slot 221 (e.g., two shown) sized and shaped to engage and retain one inner wall 215, in the installed configuration. Slots 219, 221 may be perpendicular to each other, and slot 219 may be wider and shallower than slot 221, as illustrated.

To join two of the panels 211, slot 221 of clip 213 is snapped onto one inner wall 215 of one panel. The other panel 211 is perpendicularly placed next to the first panel 211 to form a corner. For example, FIG. 12 shows right panel 211 overlapping left panel 211, and FIG. 13 shows left panel 211 overlapping right panel 211. Slot 219 of clip 213 may then be snapped onto the rib 217 on the other panel 211 to hold the panels 211 together. Accordingly, this design and the clip 213 are reversible, such that either panel 211 can overlap the other.

In still other embodiments, the system, method or article may include one or more of the following items:

Embodiment 1

A corner siding product, comprising a plurality of panels, each panel comprising a front face, a back surface opposite the front face, and an inner wall extending from the back surface and formed at least partially along a perimeter of the panel, wherein at least one of the panels comprises a rib extending from the back surface; and a clip comprising a first slot configured to engage the rib of one of the plurality of panels and a second slot configured to engage at least one of the inner walls of another of the plurality of panels to hold the panels in direct contact with each other.

Embodiment 2

The corner siding product of embodiment 1, wherein the rib extends rearward from the back surface.

Embodiment 3

The corner siding product of embodiment 1, wherein the first slot and the second slot are substantially perpendicular.

Embodiment 4

The corner siding product of embodiment 1, wherein the first slot is wider than the second slot.

Embodiment 5

The corner siding product of embodiment 1, wherein the clip comprises a third slot configured to engage at least one of the inner walls of the plurality of panels.

Embodiment 6

The corner siding product of embodiment 5, wherein the second slot and the third slot are configured to engage the same inner wall of the plurality of panels.

Embodiment 7

The corner siding product of embodiment 1, wherein each of the plurality of panels comprises a rib extending from the back surface.

Embodiment 8

The corner siding product of embodiment 7, wherein the clip is reversible.

Embodiment 9

The corner siding product of embodiment 8, wherein the clip is metallic.

Embodiment 10

The corner siding product of embodiment 8, wherein the plurality of panels comprise a first panel and a second panel, wherein the first panel can overlap the second panel to form a corner, and wherein the second panel can overlap the first panel to form a corner.

Embodiment 11

A corner siding product, comprising a first panel comprising a front face, a back surface opposite the front face, and a rib extending from the back surface; a second panel comprising a front face, a back surface opposite the front face, and an inner wall extending from the back surface; and a clip comprising a first slot configured to engage the rib of the first panel and a second slot configured to engage the inner wall of the second panel to hold the first panel and the second panel in direct contact with each other.

Embodiment 12

The corner siding product of embodiment 11, wherein the rib extends rearward from the back surface.

Embodiment 13

The corner siding product of embodiment 11, wherein the first slot and the second slot are substantially perpendicular.

Embodiment 14

The corner siding product of embodiment 11, wherein the first slot is wider than the second slot.

Embodiment 15

The corner siding product of embodiment 11, wherein the clip comprises a third slot configured to engage at least one of the inner walls of the plurality of panels.

Embodiment 16

The corner siding product of embodiment 15, wherein the second slot and the third slot are configured to engage the same inner wall of the plurality of panels.

Embodiment 17

The corner siding product of embodiment 1, wherein each of the plurality of panels comprises a rib extending from the back surface.

Embodiment 18

The corner siding product of embodiment 17, wherein the clip is reversible.

Embodiment 19

The corner siding product of embodiment 18, wherein the clip is metallic.

Embodiment 20

The corner siding product of embodiment 18, wherein the first panel can overlap the second panel to form a corner, and wherein the second panel can overlap the first panel to form a corner.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A corner siding product, comprising:

a plurality of panels, each panel comprising a front face, a back surface opposite the front face, and an inner wall extending from the back surface and formed at least partially along a perimeter of the panel, wherein at least one of the panels comprises a rib extending from the back surface and spaced apart from the inner wall; and a clip comprising a first slot configured to engage the rib of one of the plurality of panels and a second slot configured to engage at least one of the inner walls of another of the plurality of panels to hold the panels in direct contact with each other.

2. The corner siding product of claim 1, wherein the rib extends rearward from the back surface.

3. The corner siding product of claim 1, wherein the first slot and the second slot are substantially perpendicular.

4. The corner siding product of claim 1, wherein the first slot is wider than the second slot.

5. The corner siding product of claim 1, wherein the clip comprises a third slot configured to engage at least one of the inner walls of the plurality of panels.

6. The corner siding product of claim 5, wherein the second slot and the third slot are configured to engage the same inner wall of the plurality of panels.

7. The corner siding product of claim 1, wherein each of the plurality of panels comprises a rib extending from the back surface.

8. The corner siding product of claim 7, wherein the clip is reversible.

9. The corner siding product of claim 8, wherein the clip is metallic.

10. The corner siding product of claim 8, wherein the plurality of panels comprise a first panel and a second panel, wherein the first panel can overlap the second panel to form a corner, and wherein the second panel can overlap the first panel to form a corner.

11. A corner siding product, comprising:

a first panel comprising a front face, a back surface opposite the front face, an inner wall extending from the back surface, and a rib extending from the back surface that is spaced apart from the inner wall;

a second panel comprising a front face, a back surface opposite the front face, and an inner wall extending from the back surface; and a clip comprising a first slot configured to engage the rib of the first panel and a second slot configured to engage the inner wall of the second panel to hold the first panel and the second panel in direct contact with each other.

12. The corner siding product of claim 11, wherein the rib extends rearward from the back surface.

13. The corner siding product of claim 11, wherein the first slot and the second slot are substantially perpendicular.

14. The corner siding product of claim 11, wherein the first slot is wider than the second slot.

15. The corner siding product of claim 11, wherein the clip comprises a third slot configured to engage at least one of the inner walls of the plurality of panels.

16. The corner siding product of claim 15, wherein the second slot and the third slot are configured to engage the same inner wall of the plurality of panels.

17. The corner siding product of claim 1, wherein each of the plurality of panels comprises a rib extending from the back surface.

18. The corner siding product of claim 17, wherein the clip is reversible.

19. The corner siding product of claim 18, wherein the clip is metallic.

20. The corner siding product of claim 18, wherein the first panel can overlap the second panel to form a corner, and wherein the second panel can overlap the first panel to form a corner.

* * * * *